US005561910A

United States Patent [19]

Maynard

[11] Patent Number: 5,561,910

[45] Date of Patent: Oct. 8, 1996

[54] SIGHTING DEVICE FOR AIMING A PROJECTILE

[75] Inventor: Bobby Maynard, Leander, Tex.

[73] Assignee: Camtrack, Dripping Springs, Tex.

[21] Appl. No.: 522,614

[22] Filed: Sep. 1, 1995

[51] Int. Cl.[6] ..... F41G 1/467

[52] U.S. Cl. ..... 33/265; 124/87

[58] Field of Search ..... 33/260, 265, 283, 33/291; 124/87

[56] References Cited

U.S. PATENT DOCUMENTS

| | | | |
|---|---|---|---|
| 3,013,336 | 12/1961 | Pennington | 33/265 |
| 3,477,130 | 11/1969 | Egan | 33/265 |
| 3,487,548 | 1/1970 | Frydenlund | 33/265 |
| 4,535,544 | 8/1985 | Jones et al. | 33/265 |
| 4,541,179 | 9/1985 | Closson | 33/265 |
| 4,580,349 | 4/1986 | Webb et al. | 33/265 |
| 4,616,422 | 10/1986 | Gaddy | 33/265 |
| 4,635,374 | 1/1987 | Bradshaw | 33/265 |
| 4,720,919 | 1/1988 | Saunders | 33/265 |
| 4,974,328 | 12/1990 | Lowry | 33/265 |
| 5,121,547 | 6/1992 | Littlejohn | 33/265 |
| 5,253,423 | 10/1993 | Sulivan, Jr. et al. | 33/265 |
| 5,305,530 | 4/1994 | Robertson, Jr. et al. | 33/265 |
| 5,388,336 | 2/1995 | Pomaville | 33/265 |

FOREIGN PATENT DOCUMENTS

| | | | |
|---|---|---|---|
| 1914783 | 9/1970 | Germany | 33/265 |

*Primary Examiner*—William A. Cuchlinski, Jr.
*Assistant Examiner*—G. Bradley Bennett
*Attorney, Agent, or Firm*—Baker & Botts, L.L.P.

[57] ABSTRACT

The present invention relates generally to sights and aiming aids, and more specifically to an apparatus for sighting an archer's bow.

41 Claims, 8 Drawing Sheets

SIGHTING DEVICE FOR AIMING A PROJECTILE

BACKGROUND OF THE INVENTION

With manually powered weapons, such as an archery bow, that are inherently more difficult to aim, one of the difficulties faced by an archer is determining how high or low to aim when attempting to hit a target. This decision is further complicated when the target is below the archer (as when hunting animals from a tree stand) or when the target is above the archer (as when an animal is on a hill). This decision becomes further complicated when the target is an animal that moves away from or towards the archer. As a result, a variety of bow sights have been developed to aid the archer to accurately aim at the target.

One type of bow sight employs a series of sighting pins calibrated to different distances. This type of sight arrangement only provides accurate sighting at the discreet interval defined by the various pins. For example, the sight arrangement might require the archer to utilize the first pin when the target is ten yards from the archer, the second pin when the target is twenty yards from the archer, and so on as the target's distance from the archer increases. This type of arrangement is inconvenient, as an archer must use a different pin or cross hair for targets at different distances. Furthermore, an archer has to determine which pin to use prior to making the shot. Furthermore, since the sights are calibrated for particular distances, the hunter must estimate the distance to the target and use the pin calibrated to that distance to sight the target. These sights also require the hunter to approximate when the target is at a distance between one of the calibrated distances. Furthermore, these sighting arrangements are designed for use when the archer and the target are at substantially the same elevation. Because the fixed pin sight arrangement assumes the angle of the bow, the pins are no longer calibrated for the same distances as a ground level shot when the archer is elevated above the target or visa versa. Thus, these arrangements tend to be limited to uses when the archer and the target are on the same elevation.

Attempts to overcome the limitations of shooting to different elevations have resulted in pendulum type sighting devices that pivot relative to the bow. These sights tend to position a cross hair or sight pin along an arc defined by the distance between the pin or cross hair to the pivot point. While these pendulum sights can aid the archer for aiming at either a target above or a target below the archer, they do not accurately sight for both. A pendulum bow sight for use at both elevated and ground level positions tends to have at least two sets of cross hairs or sight pins, one pendulum and one stationary, in order to effectively sight at both positions. None of these devices have adequately resolved the problem of providing continuous sighting with a single sight element while compensating for both elevation and range of the target with respect to the archer.

SUMMARY OF THE INVENTION

One aspect of the present invention is a sighting device that has a positioning mechanism that adjusts the position of a movable sighting element through at least two paths of motion. The sighting element is typically a cross hair or other means of establishing a line of sight to the target. Which path of motion the sighting element follows is determined by the position of the target with respect to the sight. In one embodiment of the invention, the sighting element moves through three paths of motion. One path of motion is defined for ground shots. A ground shot occurs when the target is at substantially the same elevation as the sight. A second path of motion is defined for a downward shot. A downward shot occurs when the target is below the sight (as when an archer utilizes a tree stand to hunt animals on the ground below the stand). A third path of motion is defined for an upward shot. An upward shot occurs when the target is above the sight (as when an archer aims at a target on a hill).

A technical advantage of the invention is that the separate paths of motion defined for the sighting element allow accurate sighting when the target is at substantially the same elevation as the sight, when the target is elevated above the sight, and when the target is positioned below the sight. Another advantage of the present invention is the utilization of a single sighting element that continuously sights as the target changes elevation and range. A further advantage off the present invention is that the invention requires no additional adjustment prior to each shot. Another advantage of the present invention is that a single sighting element is used as the elevation and range of the target change.

DETAILED DESCRIPTION OF THE INVENTION

Embodiments of the present invention are illustrated in the FIGURES, like numerals being used to refer to like and corresponding parts of the various drawings. For purposes of example, the sighting device of the present invention is used with an archery bow. However, it should be understood that the sighting device is useful for aiming any projectile at a target and could be used in conjunction with any projectile system capable of propelling a projectile, with a bow and arrow being an example of such a system.

Figure 1:
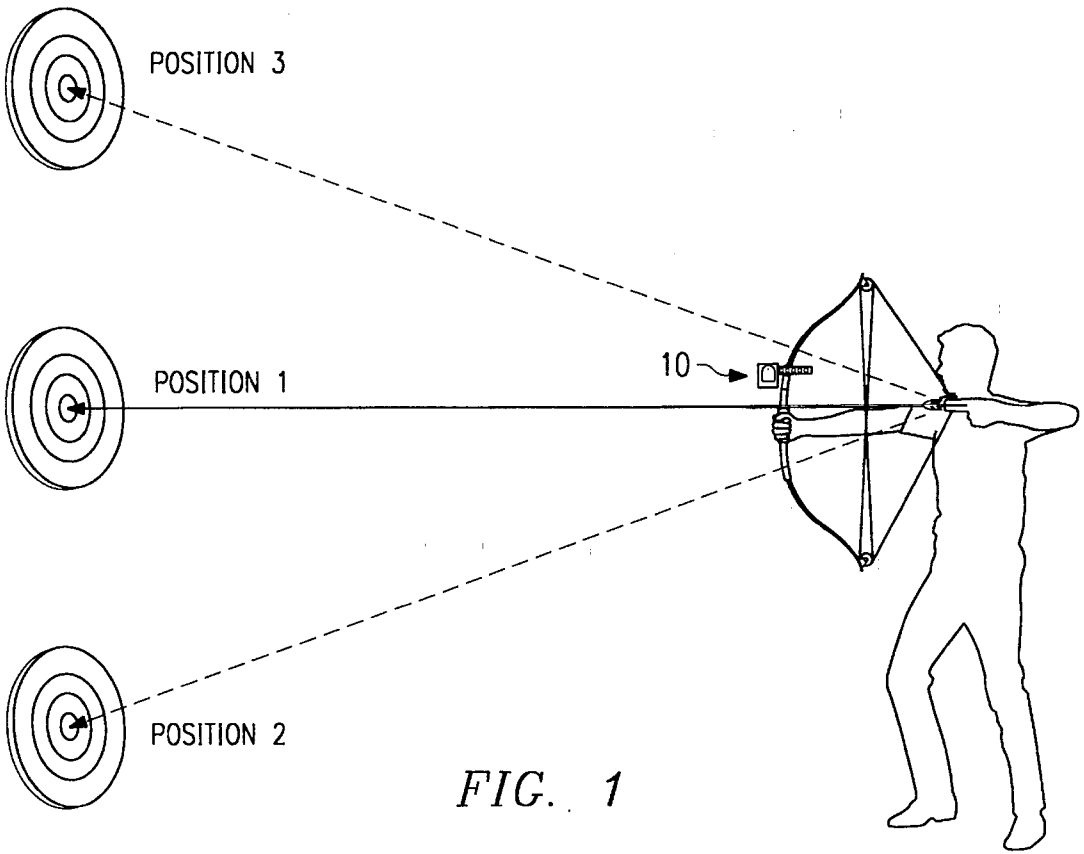
FIG. 1 depicts an archer drawing an archery bow with an embodiment of the sighting apparatus according to the present invention attached to the bow.

FIG. 1 illustrates various positions of a target with respect to a bow sight 10, which as stated in the previous paragraph is an application of a sighting device in accordance with the present invention. The target at position 1 illustrates a target position substantially at the same elevation as the bow sight 10. In this position, the archer and the target occupy generally the same plane and the bow sight must adjust to accurately sight as the target changes distance from the bow sight 10. The target at position 2 illustrates a target below the bow sight 10. The target at position 3 illustrates a target above the bow sight 10. The bow sight 10 is illustrated as having no tilted angle for shooting along a "flat" trajectory to a target at position 1 as might occur for a target at a close proximity to the bow sight 10. As explained more fully below, the bow sight 10 generally allows the archer to determine the angle to tilt the bow upward to provide the appropriate trajectory for the arrow when aiming at a distant target in position 1. At positions 2 and 3, the bow sight 10 adjusts to compensate for both elevation above or below the target and distance from the target.

Figure 2:
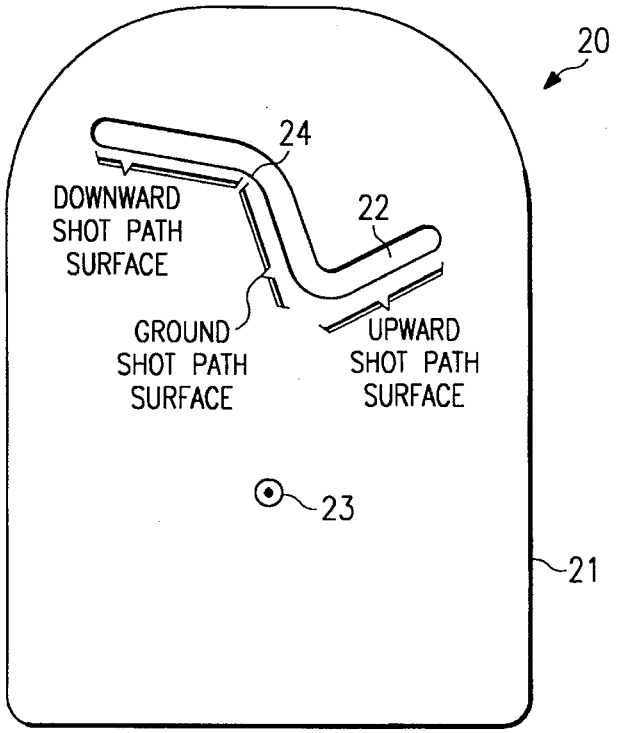
FIG. 2 shows an embodiment of the positioning mechanism of the present invention.
Figure 3:
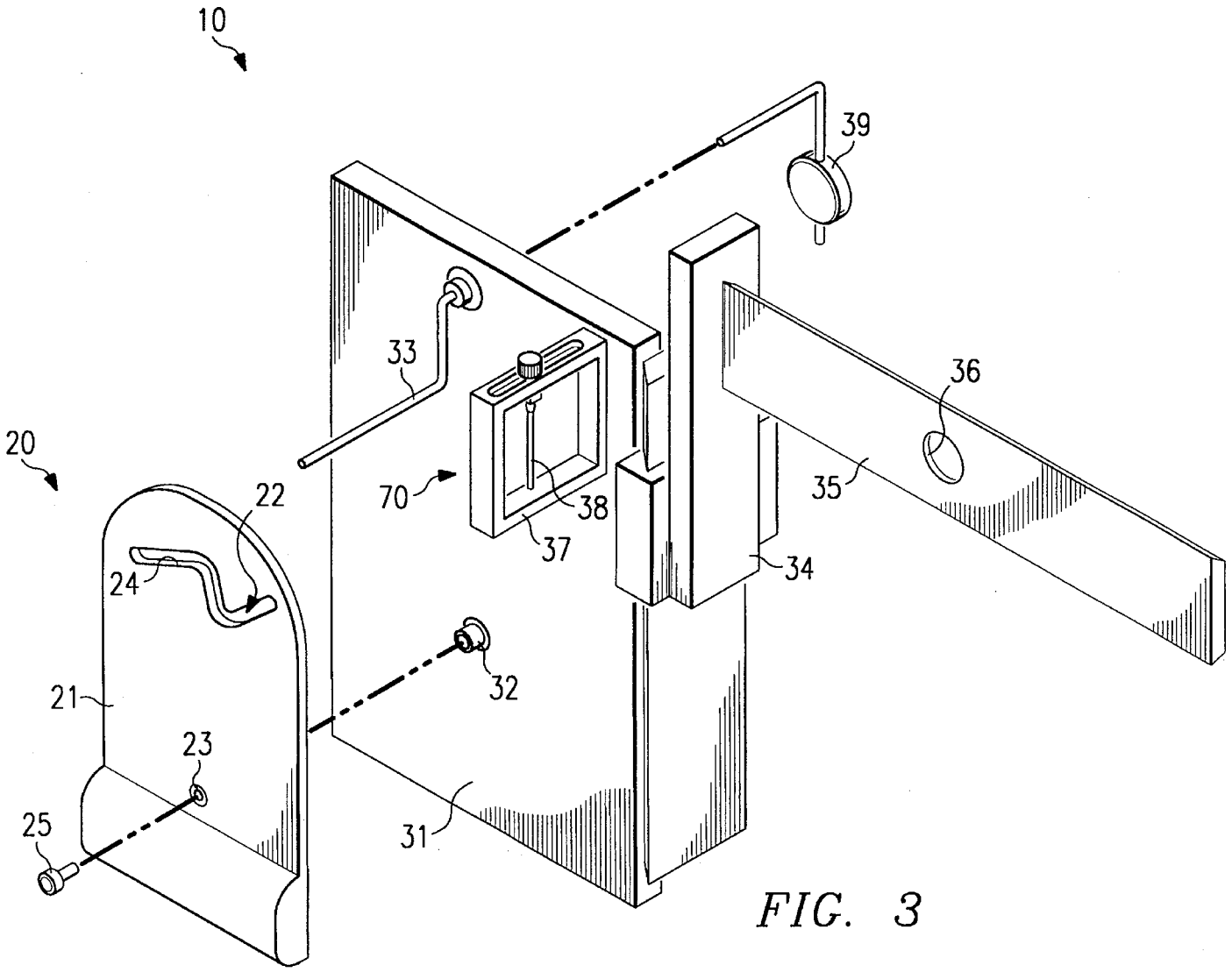
FIG. 3 is a perspective view of an embodiment of the present invention.

FIGS. 2 and 3 illustrate one embodiment of the present invention. FIG. 3 is an exploded view of a bow sight 10, having a positioning mechanism 20, and a sighting element 33 shown as a cross hair. Both FIGS. 2 and 3 illustrate three paths of motion the sighting element 33 moves through as provided for by the positioning mechanism 20. The positioning mechanism 20 has a body 21 with a positioning slot 22 and a pivot pin receptacle 23 cut out of the body 21. The surface of the body 21 defining the positioning slot 22 forms a positioning surface 24. The contour of positioning surface 24 can be shaped to define at least two paths of motion for the sighting element 33 of FIG. 3 to travel. The positioning mechanism 20 can be made from a variety of rigid building materials including plastics, metal, wood, and ceramics. The positioning mechanism 20 can be constructed so that the weight of the positioning mechanism 20 is concentrated in the lower portion to aid the positioning mechanism 20 to rotate about the pivot point. In FIG. 3 the positioning mechanism 20 is shown attachable to the frame 31 of the bow sight 10 by a nut 25. A pivot pin 32 is attached to the frame 31 and is positioned on the frame 31 so that the pivot pin 32 will insert into the pivot pin hole 23. One side of a vertical arm 34 is attached to the frame 31, while the opposing side is attached to a horizontal arm 35 that contains a mounting hole 36. The horizontal arm and the vertical arm provide an attachment assembly that connects the bow sight 10 to the bow (so that the positioning mechanism 20 faces the bow) by use of a threaded nut sized to match the mounting hole 36 that runs through the horizontal arm 35 and into the bow.

The embodiments of FIGS. 2 and 3, like other embodiments described herein, all show a bow sight 10 designed for use by a right handed archer. However, the invention could also be built for a left handed archer by reversing the components and mounting the bow sight 10 to the opposite side of the bow.

A sight assembly 70 attaches to the outer surface of the frame 31 and includes a sight housing 37, having generally a rectangular shape and defining an opening through which the archer sights, and a vertical cross hair 38. The vertical cross hair 38 extends down the opening in the sight housing 37 and can be attached to the sight housing 37 at a position spaced from the vertical walls of the sight housing 37. A sighting element 33 attaches to the frame 31 and passes through the frame 31. The sighting element 33 of the present embodiment forms a horizontal cross hair that intersects with the vertical cross hair 38 and within the sight housing 37. This intersection of the horizontal and vertical cross hairs provides a line of sight for the archer to the target. The sighting element 33 can be counter weighted with a counterweight 39 on the side of the frame 31 opposite the positioning mechanism 20 to reduce the force required to move the sighting element 33 across the positioning surface 24 when the sight is in operation.

Once the present embodiment is installed onto the bow, the archer looks through the sight housing 37 at a target. The sighting element 33, in this embodiment a horizontal cross hair, rests on the positioning surface 24 due to the force of gravity. As the bow is tilted upward or downward, the bow sight 10 moves accordingly. As the bow sight 10 is tilted, the positioning mechanism 20 rotates about the pivot pin 32. As viewed by the archer when sighting, the sighting element 33 changes its intersection point with the vertical cross hair 38 as it follows the path defined by the positioning surface 24. As the positioning mechanism 20 rotates about the pivot pin 32, the point along the positioning surface 24 upon which the sighting element 33 contacts can change. The contour of the positioning surface 24 defines the distance the sighting element 33 will rise or fall along the vertical cross hair 38 as perceived by the archer. In other words, the intersection point of the sighting element 33 and the vertical cross hair 38 will change as the positioning mechanism 20 rotates. The change in the contour of the positioning surface 24 allows the sighting element 33 to move through at least two paths of motion, shown in FIG. 2 as three paths of motion. The ability to move the sighting element 33 through three paths of motion allows the sighting system 10 to provide accurate sighting when the target is on substantially the same plane as the bow sight 10, above the bow sight 10, or below the bow sight 10.

The positioning surface 24 shown in FIG. 3 defines three paths of motion for the sighting element 33, the ground shot path, the downward shot path, and the upward shot path. The positioning mechanism 20 works to move through a cammed motion that translates the rotational movement of the positioning mechanism 20 to a movement of the sighting element 33 up and down the vertical cross hair 38 as viewed by the archer through the sight housing 37.

Figure 4A:
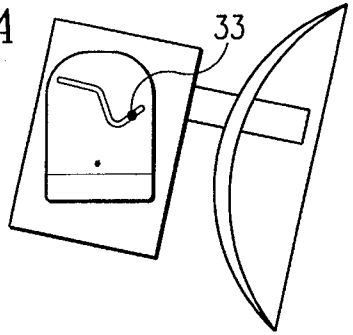
FIG. 4A shows an embodiment of the present invention with the sight element in an upward shot path position.
Figure 4B:
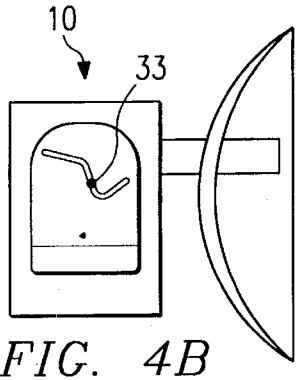
FIG. 4B shows an embodiment of the present invention with the sight element in a ground shot path position.
Figure 4C:
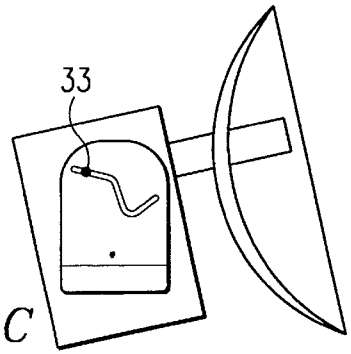
FIG. 4C shows an embodiment of the present invention with the sight element in a downward shot path position.

FIG. 4B shows the sighting element 33 in a position along the ground shot path surface 24. The ground shot path is the path the sighting element 33 follows as it moves along the portion of the positioning surface 24 labeled ground path shot surface in FIG. 2. The ground shot path is the path the sighting element 33 follows when the bow sight 10 is aimed at a target that is at substantially the same elevation as the bow sight 10, as when the target is in position 1 of FIG. 1. FIG. 4C shows the sighting element 33 in a position along the downward shot path surface 24. The downward shot path is the path the sighting element 33 follows as it moves along the portion of the positioning surface 24 labeled downward shot path surface in FIG. 2. The downward shot path is the path the sighting element 33 follows when the bow sight 10 is aimed at a target that is below the bow sight 10, as when the target is in position 2 of FIG. 1. FIG. 4A shows the sighting element 33 in a position along the upward shot path surface 24. The upward shot path is the path the sighting element 33 follows as it moves along the portion of the positioning surface 24 labeled upward shot path surface in FIG. 2. The upward shot path is the path the sighting element 33 follows when the bow sight 10 is aimed at a target that is above the bow sight 10, as when the target is in position 3 of FIG. 1.

As the target is placed (or moves) further away from the bow sight 10, the bow sight 10 must be raised, causing the positioning mechanism 20 to rotate, causing the sighting element 33 to move to a different position. Likewise, if the target is placed (or moves) to a higher or lower position with respect to the bow sight 10, the bow sight must be raised or lowered accordingly, causing the positioning mechanism 20 to rotate, causing the sighting element 33 to move to a different position. The different positions of the sighting element 33 are defined by the contour or shape of the positioning surface 24 of the positioning mechanism 20. The positioning mechanism 20 could be modified so that the sighting element would only move through two paths of motion, thus allowing the bow sight 10 to accurately and continuously sight in two of the three positions shown in FIG. 1.

The contour of the positioning surface 24 that defines the paths of motion that the sighting element 33 will follow can be determined by experimentation or through mathematical calculation based on a variety of variables. These variables include the weight of the arrow, the initial velocity of the arrow as it leaves the bow string, and the size and shape of the arrow. An experimental method of determining the contour of the ground shot path surface as shown in FIG. 2 involves defining the position of the sighting element 33 that forms an intersection with the vertical cross hair 28 such that the intersection of them accurately sights to a target at a known distance (for example 10 yards) at substantially the same elevation as the bow sight 10. The target is then moved further away at substantially the same elevation as the bow sight 10 (for example 20 yards) and the position of the sighting element 33 that forms an intersection with the vertical cross hair 28 such that the intersection of them accurately sights to the target at the second known distance can be determined. The contour or shape of the positioning surface 24 will then be defined by a surface that will support the sighting system 33 at each of the two known positions as the positioning mechanism 20 rotates about the pivot pin 32. By connecting the line between these two points, a positioning surface 24 is defined for ground level shots between the two known distances. If the known distances used were 10 and 20 yards, the shape between the two known positions would define a positioning surface on which the sighting element would rest for ground shots between 10 and 20 yards. This contoured positioning surface would then define the path the sighting element 33 would follow in order to translate the line of sight to a proper departure angle for the projectile. In other words, when the sighting element 33 and the target are aligned, the projectile system will be correctly positioned to send a projectile to the target. The shape of the surface can be refined by increasing the number of known positions. For example, if positions of the sighting element are known for targets at 10, 20, 30 and 40 yards from the bow sight, the shape of the curve connecting those known positions will allow an archer to accurately sight for ground level shots ranging from 10 to 40 yards. The shape could be further refined by reducing the interval between the known positions. For example, the shape of the positioning surface would be even more accurate if the known positions occurred at 5 yard intervals of 10, 15, 20, 25, 30, 35, and 40 yards. The contour of the positioning surface for downward shot path and the upward shot path are similarly determined. As noted earlier, the contour or shape of the positioning surface can change depending on a variety of variables including the initial velocity of the arrow as it leaves the bow, the weight of the arrow, and the size and shape of the arrow. This allows the advantage of tuning the present invention for particular bows and arrows.

Figure 5:
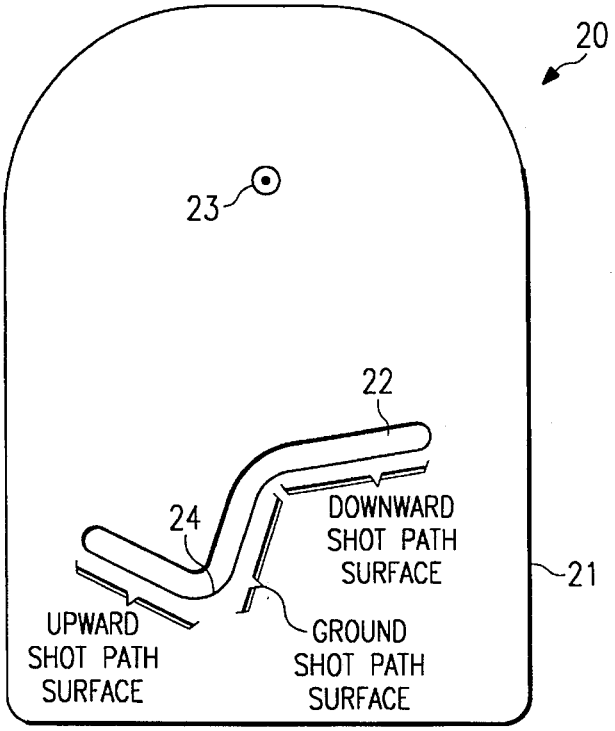
FIG. 5 shows another embodiment of the positioning mechanism of the present invention.

FIG. 5 illustrates a variation of the positioning mechanism 20. The positioning mechanism 20 consists of a body 21 with a positioning slot 22 and a pivot pin receptacle 23 cut out of the body 21. The surface of the body 21 defining the positioning slot 22 forms a positioning surface 24. The positioning surface 24 can be shaped to define three paths of motion for the sighting element to follow; as shown in FIG. 5 as the upward shot path surface, the ground shot path surface, and the downward shot path surface. The positioning mechanism 20 of FIG. 5 is similar to the positioning mechanism 20 in FIG. 2, except that the positioning surface 24 is lower on the positioning mechanism 20 and the pivot pin receptacle 23 is nearer the top of the positioning mechanism 20. The embodiment of the positioning mechanism 20 depicted in FIG. 5 attaches to the bow sight 10 at the pivot pin receptacle and accomplishes the function of moving the sighting element through three paths of motion by rotating through a cammed motion about the pivot pin receptacle as the bow sight 10 tilts upward or downward.

Figure 3A:
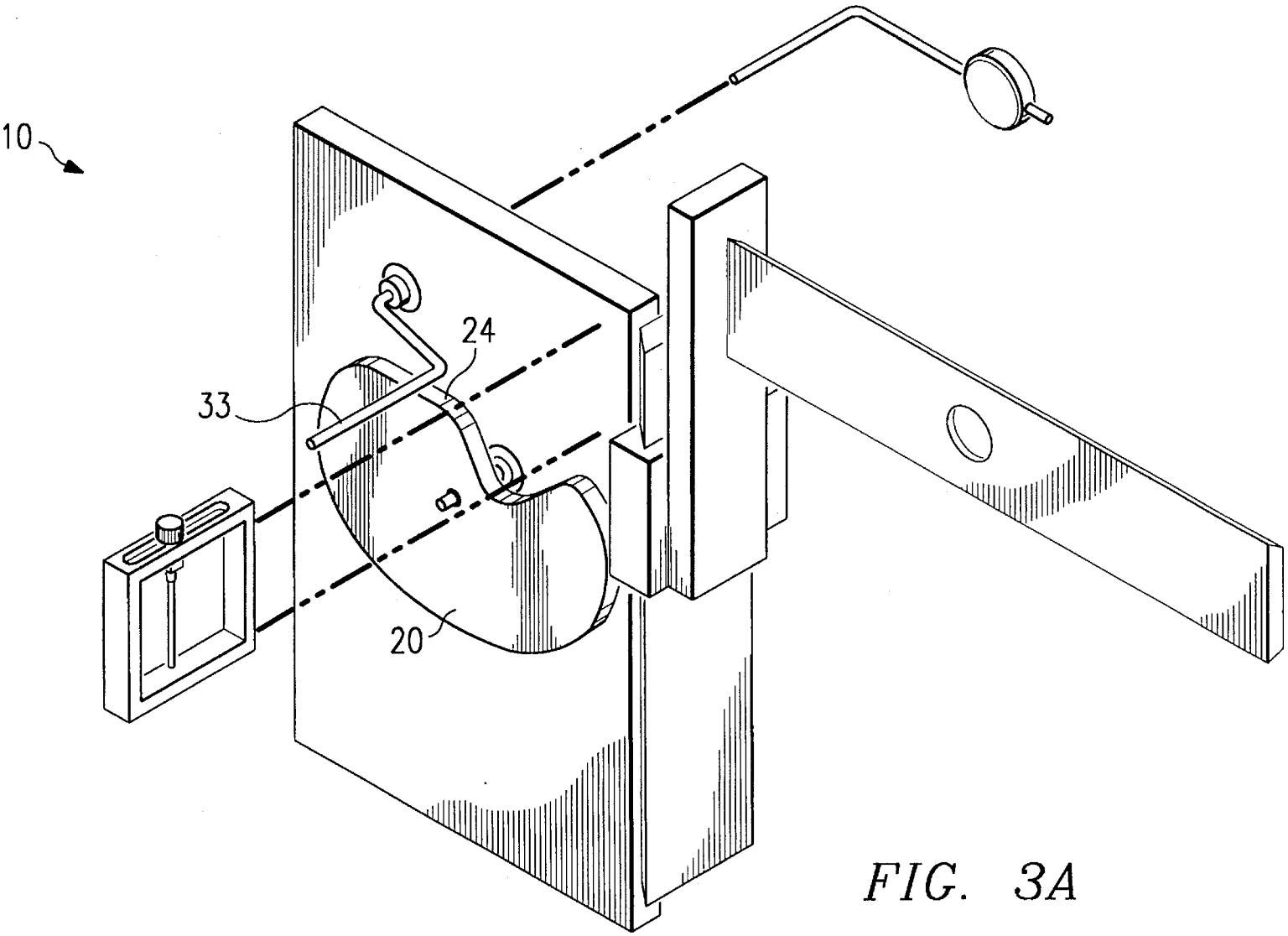
FIG. 3A is a perspective view of another embodiment of the present invention.

Another embodiment of the present invention is shown in FIG. 3A. FIG. 3A utilizes a positioning mechanism 20 that is a cam. The top of the positioning mechanism 20 provides a positioning surface 24 upon which the sighting element 33 rests. The shape of the positioning mechanism 20 allows it to rotate as the bow sight 10 is tilted. As the positioning mechanism 20 rotates, the point of contact between the positioning mechanism 20 and the sighting element 33 changes. By changing the position of the sighting element 33, the positioning mechanism 20 as shown in FIG. 3A moves the sighting element 33 through three paths of motion to allow continuous sighting of a target while compensating for both distance and elevation.

Figure 6:
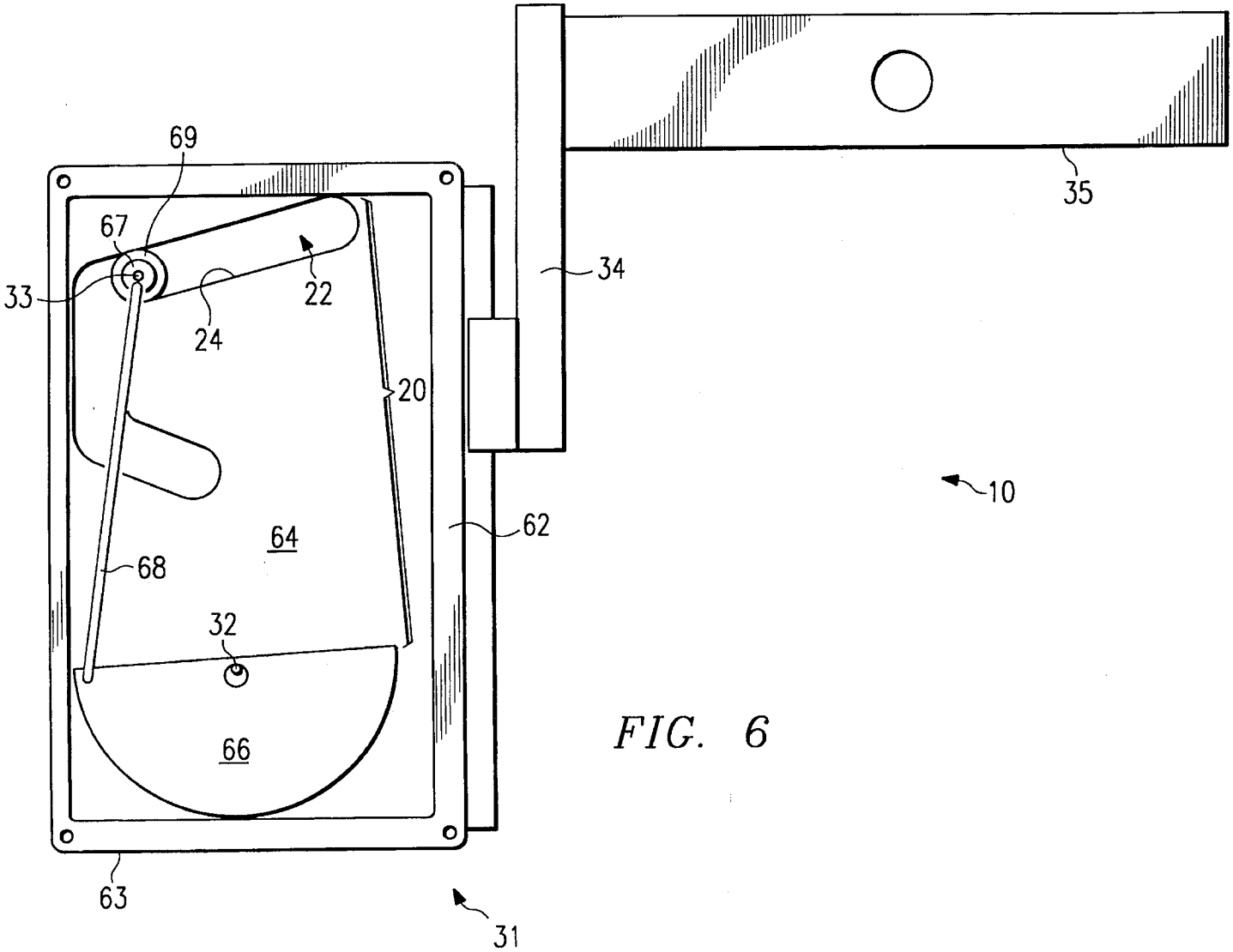
FIG. 6 shows a side view of another embodiment of the present invention.
Figure 7:
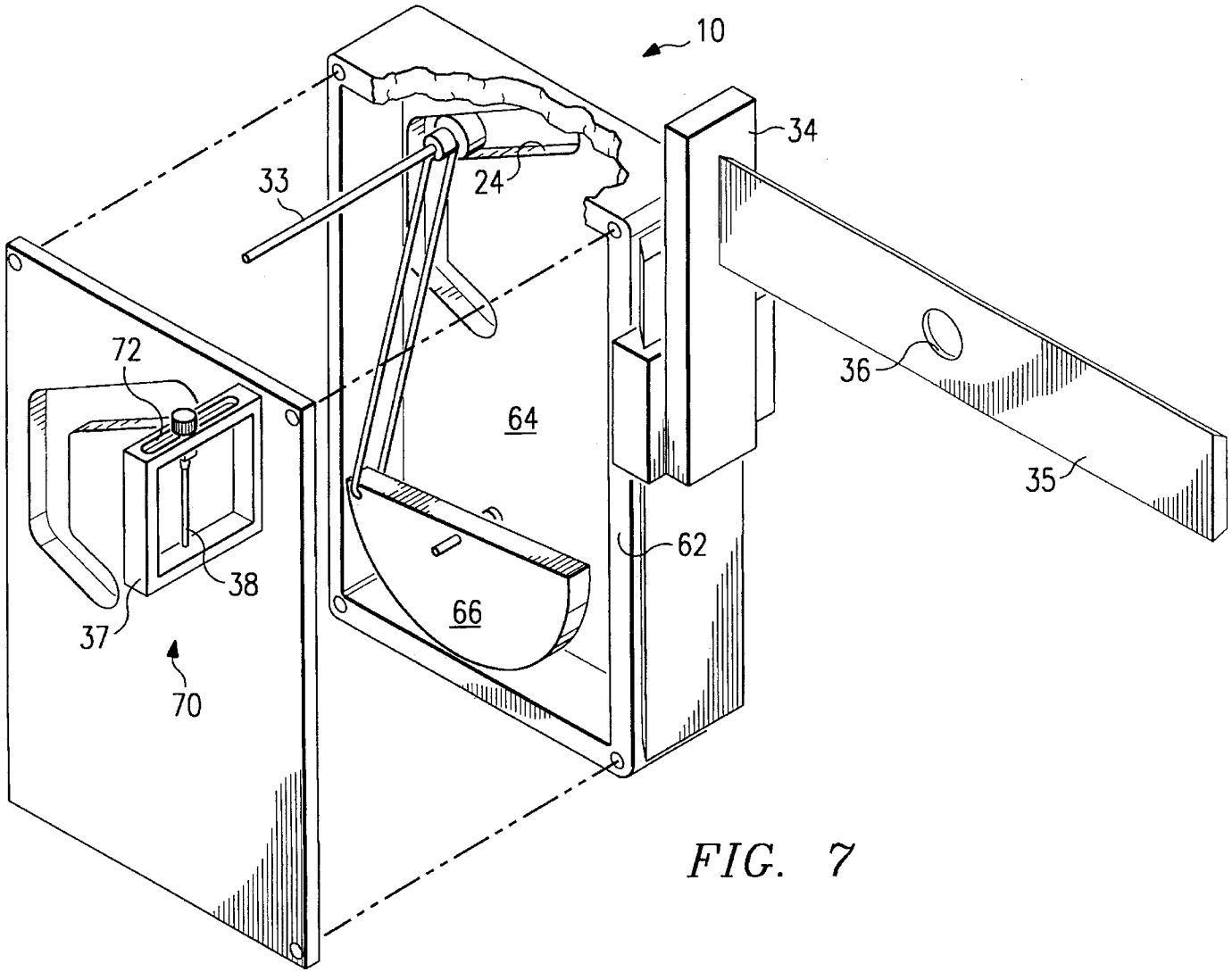
FIG. 7 is a perspective view of the embodiment of the present invention shown in FIG. 6.

FIGS. 6 and 7 illustrate another embodiment of the present invention. FIG. 7 is an exploded view of a bow sight 10 having a positioning mechanism 20, shown in FIG. 6 as comprising a positioning surface 24, a pendulum weight 66, and a pendulum arm 68 attached to the pendulum weight 66 at one end and attached to the sighting element 31 at the opposite end. FIG. 6 is a cut-away view of the bow sight 10 to show a side view of the positioning mechanism 20. The frame 31 includes a housing 62 formed in generally a rectangular shape, an outer surface 63, an inner surface 64 that defines a positioning slot 22, and an opening in the outer surface 63 shaped substantially the same, and aligning with, the positioning slot 22. A sighting element 33, in the form of a horizontal cross hair, is attached to the wheel and extends out from the wheel 69 approximately perpendicular to the inner surface 64. The pendulum weight 66 can be formed in a variety of shapes, including the shape of a crescent as shown in FIG. 6. The pendulum weight 66 pivots by means of a pivot pin 32 extending from the inner surface 64 of the housing 62. The pendulum arm 68 attaches to the pendulum weight 66 so that as the bow sight 10 is tilted downward causing the pendulum weight 66 to rotate counterclockwise, the pendulum arm 68 will also move downward in the vertical direction. The pendulum arm 68 is inserted into the pendulum weight 66 through a hole drilled through the pendulum weight 66. The pendulum arm 68 of the embodiment of FIG. 6 is a generally rectangular metal piece, though other rigid materials could be used. The end of the pendulum arm 68 opposite the end attached to the pendulum weight 66 attaches to a connecting assembly 67 that connects the sighting element 33, the pendulum arm 68, and the wheel 69. The wheel 69 will move along the positioning surface 24 as the pendulum weight 66 moves. The opening in the outer surface 63 of the housing 62 is shaped substantially the same as the positioning slot 22.

The attachment assembly, used to attach the bow sight 10 to a bow, includes a vertical arm 34 attached to the housing 62 on one end and to a horizontal arm 35 on the opposite end. The bow sight can be attached to the bow by a nut that can be thread through the mounting hole 36 in the horizontal arm and into a comparably threaded hole in the bow.

A sight assembly 70 attaches to the outer surface of the housing 62. The sight assembly 70 includes a sight housing 37 having generally a rectangular shape and defining an opening through which the archer sights, a vertical cross hair 38, and an opening in the sight housing shaped substantially the same as the positioning slot. The vertical cross hair 38 extends down the opening in the sight housing 37 and is attached to the sight housing 37 at a position spaced from the vertical walls of the sight housing 37. The sight housing 37 can include a cross hair slot 72 through which the vertical cross hair 38 can be attached. The cross hair slot 72 allows adjustment of the position of the cross hair 38 in relation to the vertical walls of the sight housing 37.

When the embodiment of the bow sight 10 shown in FIGS. 6 and 7 is tilted up or down, as when aiming the bow, the pendulum weight 66 rotates due to the force of gravity, causing the pendulum arm 68 to change position. As the pendulum arm 68 changes position, the wheel 69 moves along the positioning surface 24. The sighting element 33 moves along a similar path as the wheel 69. The wheel 69 can facilitate movement along the positioning surface 24, however, the sight element 33 could rest directly upon the positioning surface 24. The positioning slot 22 defines three paths of motion that the wheel 69, and accordingly the sighting element 33, will travel along the positioning surface 24. These three paths of motion are the ground shot path, the downward shot path, and the upward shot path. As described earlier, the ground shot path is the path the sighting element 33 travels when the sighting system 10 is used to sight a target at substantially the same elevation as the sighting system 10; the downward shot path is the path the sighting element 33 travels when the sighting system 10 is used to sight a target below the sighting system 10; and the upward shot path is the path the sighting element 33 travels when the sighting system 10 is used to sight a target above the sighting system 10. This embodiment of the present invention allows continuous sighting of a target through a single sight element over a range of distances and elevations.

Figure 8:
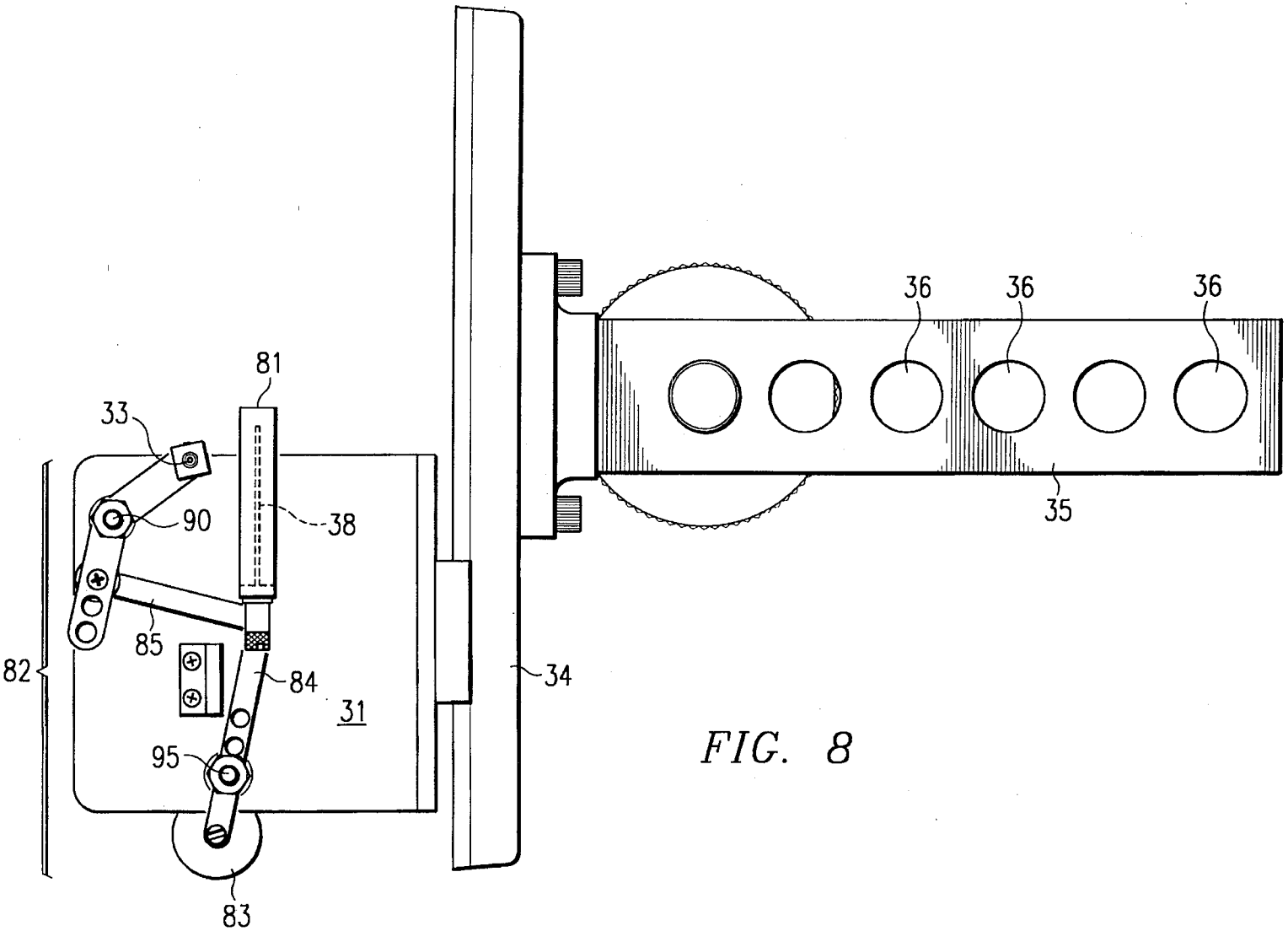
FIG. 8 shows a side view of another embodiment of the present invention.
Figure 9:
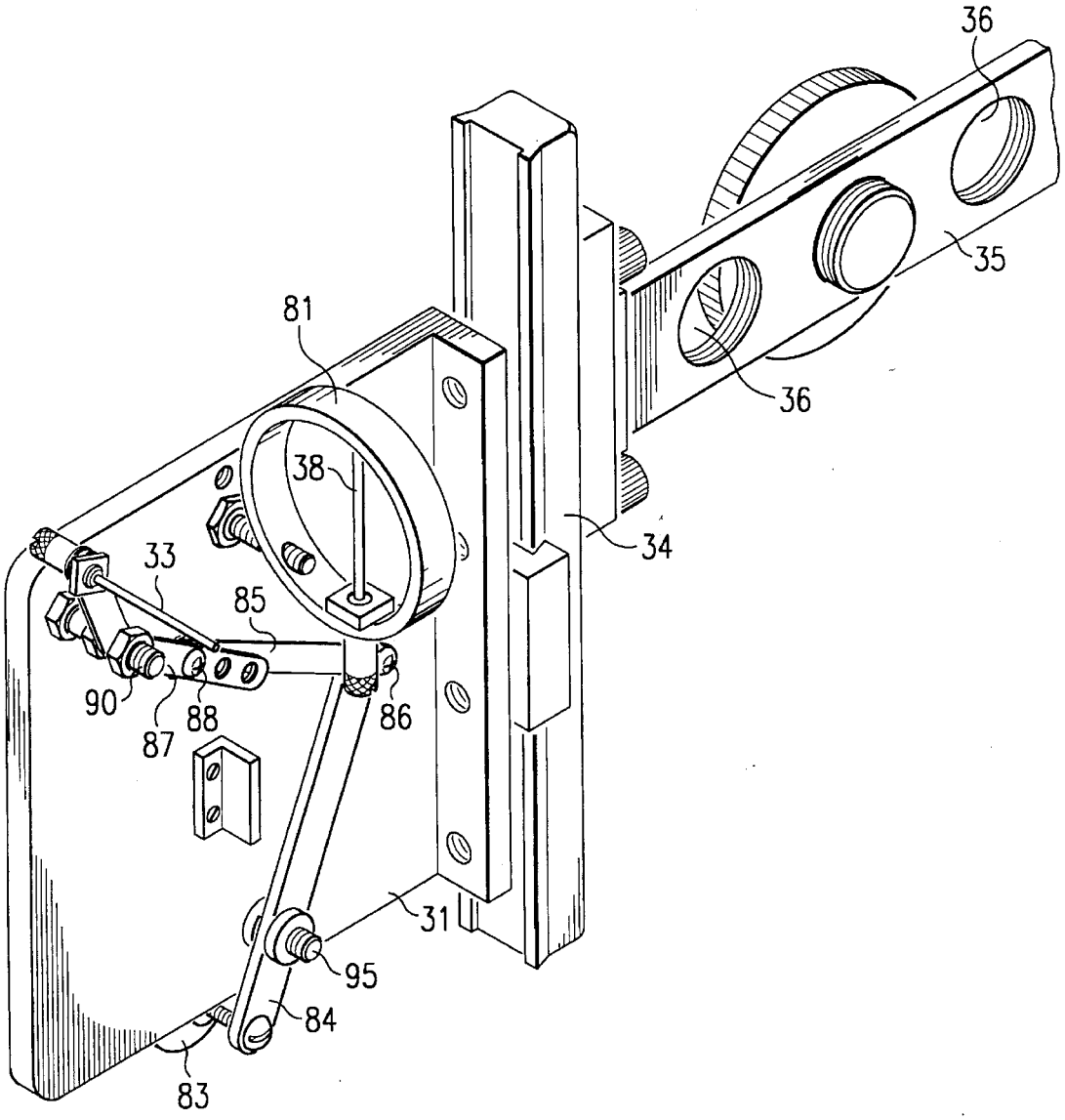
FIG. 9 is a perspective view of the embodiment of the present invention shown in FIG. 8.

FIGS. 8 and 9 illustrate another embodiment of the present invention whose positioning mechanism 82 uses a plurality of levers and pivot points to define two paths of motion for the sighting element 33. FIG. 8 shows a circular sight housing 81 attached to the frame 31 with a screw mounted through the frame 31 and embedded in the circular sight housing 81. A vertical cross hair 38 is attached to the lowest portion of the circular sight housing 81 with a nut and bolt connection. A vertical arm 34 is attached to the frame 31 on one end and to a horizontal arm 35 on the opposite end. The bow sight 10 can be attached to the bow by a nut thread through the mounting hole 36 in the horizontal arm and into a comparably threaded hole in the bow. The horizontal arm 35 as shown in FIGS. 8 and 9 includes multiple mounting holes 36 that could be used to mount the bow sight 10 to the bow. This allows flexibility as to the mounting position of the bow sight 10 on the bow.

A positioning mechanism 82 includes a pendulum weight 83 that attaches to the side of frame 31 opposite the circular sight housing 81. The bottom portion of the pendulum weight 83 is attached by means of a threaded screw and nut to first lever 84. The first lever 84 moves as the weight 83 moves and rotates about the pivot pin 95 that is attached to the frame 31. The first lever 84 is attached to a second lever 85 that pivots around the connection point 86 between the first lever 83 and second lever 85. A third lever 87 is attached to the second lever 85 and pivots around the connection point 88 between the second lever 85 and the first lever 87. While the first lever 84 and second lever 85 are straight, the third lever 87 is angled. At the angle point of the third lever 87 a screw attaches the third lever 87 to the frame 31 and the third lever 87 pivots about the attaching screw. A sighting element 33, in the form of a horizontal cross hair, is attached to the end of the third lever 87, opposite the pivot point 88, and positioned approximately perpendicular to the frame 31. The length and position of the levers have been chosen such that the sighting element 33 changes its position, and thus the point of intersection with the vertical cross hair 38 when viewed through the circular sight housing 81, as the bow sight 10 is tilted up and down. The embodiment of FIGS. 8 and 9 moves the sighting element 33 through two paths of motion—the ground shot path and the downward shot path when the bow sight 10 is tilted. The pendulum weight 83 pivots about the point of attachment when the bow sight 10 is tilted upward or downward, causing the levers 84, 85, and 87 to move, leading to the movement of the sighting element 33. This embodiment allows continuous sighting utilizing a single sight element for targets at substantially the same elevation or below the bow sight 10. This embodiment will adjust the position of the sighting element 33 over a range of distances and elevations provided the target is at substantially the same elevation or below the bow sight 10.

A common feature of the various embodiments of the present invention is that the positioning mechanism provides a cammed motion to adjust the sighting element 33 along different paths of motion. The cammed motion of the positioning mechanism 20 (or 82) moves the sighting element 33 to different positions relative to the vertical cross hair 38 as viewed through the bow sight 10 by the archer. When a target is at position 1, the positioning mechanism 20 (or 82) adjusts the position of the sighting element 33 along a ground shot path. When the target is at position 2, the positioning mechanism 20 (or 82) adjusts the position of the sighting element 33 along a downward shot path. For those embodiments capable of moving the sight element 33 through a third path of motion, when the target is at position 3, the positioning mechanism 20 (or 82) adjusts the position of the sighting element 33 along an upward shot path. This cammed motion allows the positioning mechanism 20 (or 82) to adjust the sighting element 33 to accurately and continuously sight a target as the target changes its distance or its elevation relative to the bow sight 10. The positioning mechanism 20 (or 82) translates any change in the bow angle to a change in the archer's line of sight (as determined by the alignment of the sighting element and the target), so that when the line of sight is on the target, the tow is at the correct angle for reaching the target.

Another common feature of the various embodiments of the present invention is that each can be manufactured as an add-on device for existing bows. However, each embodiment could be easily modified so that the sighting element and positioning mechanism are integral to the bow (or projectile system).

Although the present invention has been described in detail, it should be understood that various changes, substitutions and alterations can be made hereto without departing from the spirit and scope of the invention as defined by the appended claims.

What is claimed is:

1. A sighting device for use with a projectile system operable at different departure angles, to aid in aiming a projectile at a target comprising;

a movable sighting element for providing a line of sight to said target; and a positioning mechanism mounted to said projectile system operable to move said sighting element through at least two paths of motion as said projectile system is set at one or more of said different departure angles, wherein a first path of motion is a ground shot path when said target is at substantially the same elevation as said sighting device and a second path of motion is a downward shot path when said target is at an elevation below said sighting device.

2. The sighting device of claim 1 wherein said positioning mechanism is further operable to move said sighting element through a third path of motion, said third path of motion being an upward shot path when said target is at elevations above said sighting device.

3. The sighting device of claim 1 wherein said sighting element comprises a horizontal cross hair.

4. The sighting device of claim 1 wherein said sighting element comprises a pin.

5. The sighting device of claim 1 further comprising a sight assembly comprising;

a sight housing coupled to said projectile system; and a vertical cross hair coupled to said sight housing.

6. The sighting device of claim 1 wherein said positioning mechanism comprises;

a body operable to pivot as said projectile system is set at said departure angles;

a positioning surface that guides said sighting element along said at least two paths of motion.

7. The sighting device of claim 6 wherein said body includes a positioning slot to define said positioning surface.

8. The sighting device of claim 6 wherein said body is a cam, formed to define said positioning surface.

9. The sighting device of claim 1 wherein said positioning mechanism has;

a frame with a positioning surface that guides said sighting element through said at least two paths of motion;

a pendulum weight that pivots at a first point as said projectile system is set at said departure angles; and a pendulum arm having a first end coupled to said pendulum weight at a second pivot point and having a second end coupled to said sighting element such that said sighting element moves along said positioning surface as said pendulum weight pivots.

10. The sighting device of claim 1 wherein said positioning mechanism comprises;

a pendulum weight; and a plurality of levers connected by a plurality of pivot points operable to position said sighting element.

11. The sighting device of claim 10 wherein said plurality of levers comprises;

a first lever coupled to said pendulum weight at one end and to a connecting arm at the other end, operable to pivot around a first fixed pivot point;

said connecting arm movably connected to said first lever at one end and further movably connected to a second lever at the other end, operable to pivot at both connections; and said second lever coupled to said connecting arm and further coupled to said sighting element operable to pivot around a second fixed pivot point;

such that both said levers pivot in response to the motion of said pendulum weight.

12. The sighting device of claim 1, wherein said projectile system is a bow and said sighting element and said positioning mechanism are integral to said bow.

13. The sighting device of claim 1, wherein said projectile system is a bow and further comprises a housing and an attachment assembly for attaching said sighting element and said positioning mechanism to said bow.

14. A sighting device for use with a projectile system operable at different departure angles, to aid in aiming a projectile at a target comprising;

a movable sighting element for providing a line of sight to said target; and a positioning mechanism mounted to said projectile system operable to move said sighting element through at least two paths of motion as said projectile system is set at one or more of said different departure angles, wherein a first path of motion is a ground shot path when said target is at substantially the same elevation as said sighting device and a second path of motion is an upward shot path when said target is at an elevation above said sighting device.

15. The sighting device of claim 14 wherein said sighting element comprises a horizontal cross hair.

16. The sighting device of claim 14 wherein said sighting element comprises a pin.

17. The sighting device of claim 14 further comprising a sight assembly comprising;

a sight housing coupled to said projectile system; and a vertical cross hair coupled to said sight housing.

18. The sighting device of claim 14 wherein said positioning mechanism comprises;

a body operable to pivot as said projectile system is set at said departure angles;

a positioning surface that guides said sighting element along said at least two paths of motion.

19. The sighting device of claim 18 wherein said body includes a positioning slot to define said positioning surface.

20. The sighting device of claim 18 wherein said body is a cam, formed to define said positioning surface.

21. The sighting device of claim 14 wherein said positioning mechanism has;

a frame with a positioning surface for guiding said sighting element through said at least two paths of motion;

a pendulum weight that pivots at a first point as said projectile system is set at said departure angles; and a pendulum arm having a first end coupled to said pendulum weight at a second pivot point and having a second end coupled to said sighting element such that said sighting element moves along said positioning surface as said pendulum weight pivots.

22. The sighting device of claim 14 wherein said positioning mechanism comprises;

a pendulum weight; and a plurality of levers connected by a plurality of pivot points operable to position said sighting element.

23. The sighting device of claim 22 wherein said plurality of levers comprises;

a first lever coupled to said pendulum weight at one end and to a connecting arm at the other end, operable to pivot around a first fixed pivot point;

said connecting arm movably connected to said first lever at one end and further movably connected to a second lever at the other end, operable to pivot at both connections; and said second lever coupled to said connecting arm and further coupled to said sighting element operable to pivot around a second fixed pivot point;

such that both said levers pivot in response to the motion of said pendulum weight.

24. The sighting device of claim 14, wherein said projectile system is a bow and said sighting element and said positioning mechanism are integral to said bow.

25. The sighting device of claim 14, wherein said projectile system is a bow and further comprises a housing and an attachment assembly for attaching said sighting element and said positioning mechanism to said bow.

26. A sighting device for use with a projectile system operable at different departure angles, to aid in aiming a projectile at a target comprising;

a movable sighting element for providing a line of sight to said target;

a positioning mechanism mounted to said projectile system operable to move said sighting element through at least two paths of motion as said projectile system is set at one or more of said different departure angles, wherein said positioning mechanism comprises;

a body operable to pivot as said projectile system is set at said departure angles;

a positioning surface that guides said sighting element along said at least two paths of motion.

27. The sighting device of claim 26 wherein said at least two paths of motion includes a ground shot path when said target is at substantially the same elevation as said sighting device and a downward shot path when said target is at elevations below said sighting device.

28. The sighting device of claim 27 wherein said at least two paths of motion further includes an upward shot path when said target is at elevations above said sighting device.

29. The sighting device of claim 26 wherein said at least two paths of motion includes a ground shot path when said target is at substantially the same elevation as said sighting device and an upward shot path when said target is at elevations above said sighting device.

30. The sighting device of claim 26 wherein said body includes a positioning slot to define said positioning surface.

31. The sighting device of claim 26 wherein said body is a cam, formed to define said positioning surface.

32. A sighting device for use with a projectile system operable at different departure angles, to aid in aiming a projectile at a target comprising;

a movable sighting element for providing a line of sight to said target;

a positioning mechanism mounted to said projectile system operable to move said sighting element through at least two paths of motion as said projectile system is set at one or more of said different departure angles, wherein said positioning mechanism comprises;

a frame with a positioning surface that guides said sighting element through said at least two paths of motion;

a pendulum weight that pivots at a first point as said projectile system is set at said departure angles; and a pendulum arm having a first end coupled to said pendulum weight at a second pivot point and having a second end coupled to said sighting element such that said sighting element moves along said positioning surface as said pendulum weight pivots.

33. The sighting device of claim 32 wherein said at least two paths of motion includes a ground shot path when said target is at substantially the same elevation as said sighting device and a downward shot path when said target is at elevations below said sighting device.

34. The sighting device of claim 33 wherein said at least two paths of motion further includes an upward shot path when said target is at elevations above said sighting device.

35. The sighting device of claim 32 wherein said at least two paths of motion includes a ground shot path when said target is at substantially the same elevation as said sighting device and an upward shot path when said target is at elevations above said sighting device.

36. The sighting device of claim 32 wherein said sighting element is coupled to a wheel, said wheel operable to contact said positioning surface.

37. A sighting device for use with a projectile system operable at different departure angles, to aid in aiming a projectile at a target comprising;

a movable sighting element for providing a line of sight to said target;

a positioning mechanism mounted to said projectile system operable to move said sighting element through at least two paths of motion as said projectile system is set at one or more of said different departure angles, wherein said positioning mechanism comprises;

a pendulum weight;

a plurality of levers connected by a plurality of pivot points operable to position said sighting element wherein said plurality of levers comprises;

a first lever coupled to said pendulum weight at one end and to a connecting arm at the other end, operable to pivot around a first fixed pivot point;

said connecting arm movably connected to said first lever at one end and further movably connected to a second lever at the other end, operable to pivot at both connections; and said second lever coupled to said connecting arm and further coupled to said sighting element operable to pivot around a second fixed pivot point such that both said levers pivot in response to the motion of said pendulum weight.

38. The sighting device of claim 37 wherein said at least two paths of motion includes a ground shot path when said target is at substantially the same elevation as said sighting device and a downward shot path when said target is at elevations below said sighting device.

39. The sighting device of claim 38 wherein said at least two paths of motion further includes an upward shot path when said target is at elevations above said sighting device.

40. The sighting device of claim 37 wherein said at least two paths of motion includes a ground shot path when said target is at substantially the same elevation as said sighting device and an upward shot path when said target is at elevations above said sighting device.

41. A sighting device for use with a projectile system operable at different departure angles, to aid in aiming a projectile at a target comprising;

a movable sighting element for providing a line of sight to said target;

a positioning mechanism mounted to said projectile system operable to move said sighting element through at least two paths of motion as said projectile system is set at one or more of said different departure angles; and wherein said positioning mechanism comprises a positioning surface that guides said sighting element along said at least two paths of motion.

* * * * *